US006533335B2

(12) United States Patent
Hudson

(10) Patent No.: US 6,533,335 B2
(45) Date of Patent: Mar. 18, 2003

(54) SECURITY DEVICE

(75) Inventor: Barry Hudson, Victoria (AU)

(73) Assignee: Tebco Party Limited, Kowloon (HK)

( * ) Notice: Subject to any disclaimer, the term of this patent is extended or adjusted under 35 U.S.C. 154(b) by 0 days.

(21) Appl. No.: 09/736,686

(22) Filed: Dec. 12, 2000

(65) Prior Publication Data

US 2002/0070566 A1 Jun. 13, 2002

(51) Int. Cl.[7] ..... A44B 17/00; A44B 19/26

(52) U.S. Cl. ..... 292/307 R; 292/317; 292/318; 292/319; 292/320; 292/321; 70/66; 70/68; 385/5; 385/97; 385/61.3; 385/66; 24/30.5 R; 24/30.5 L; 24/429; 24/436; 24/387; 24/704.2; 190/903; 206/801; 206/810

(58) Field of Search ..... 292/307 R, 317, 292/318, 319, 320, 321; 24/30.5 L, 387, 704.2; 70/66, 68; 383/97, 5

(56) References Cited

U.S. PATENT DOCUMENTS

| | | | | | |
|---|---|---|---|---|---|
| 1,303,955 | A | * | 5/1919 | Petry | 292/317 |
| 2,032,019 | A | * | 2/1936 | Jordan | 70/68 |
| 2,055,903 | A | * | 9/1936 | Kroll | 70/68 |
| 2,778,397 | A | * | 1/1957 | Carrasco | 190/119 |
| 2,942,450 | A | * | 6/1960 | Krug | 70/68 |
| 3,138,842 | A | * | 6/1964 | Arthur | 24/615 |
| 3,955,842 | A | | 5/1976 | Edwards | |
| 3,967,350 | A | * | 7/1976 | Kawashima | 24/205.14 R |
| 3,978,697 | A | * | 9/1976 | Bako | 70/68 |
| 4,008,914 | A | | 2/1977 | Anderson | |
| 4,106,801 | A | * | 8/1978 | De Lima Castro Neto | 292/307 R |
| 4,112,990 | A | | 9/1978 | Anderson | |
| 4,512,599 | A | * | 4/1985 | De Lima Castro Neto | 292/307 R |
| 4,602,405 | A | | 7/1986 | Sturman et al. | |
| 4,685,315 | A | * | 8/1987 | Comolli | 70/68 |
| 4,817,769 | A | * | 4/1989 | Saliba | 190/18 R |
| 4,995,656 | A | * | 2/1991 | Akashi | 292/307 R |
| 5,081,855 | A | * | 1/1992 | Terada et al. | 70/68 |
| 5,681,115 | A | * | 10/1997 | Diederich et al. | 383/64 |
| 6,039,473 | A | * | 3/2000 | Bond | 385/3 |
| 6,161,959 | A | * | 12/2000 | Abraham | 383/97 |
| 6,360,411 | B1 | * | 3/2002 | Bortz | 24/704.2 |

* cited by examiner

*Primary Examiner*—Robert J. Sandy
*Assistant Examiner*—Carlos Lugo
(74) *Attorney, Agent, or Firm*—Leonard Tachner

(57) ABSTRACT

A security device for a slide fastener, including a housing adapted to be fitted to an object to which the slide fastener is attached, the housing substantially surrounding the slider of the slide fastener in its fully closed position, a closure member adapted to cooperate with the housing which, in use, covers the slider to prevent access thereto and a frangible locking element adapted to link the housing to the closure member, the locking element being resiliently yieldable and slidably insertable into the closure member but not retractable therefrom without fracturing the frangible locking element. The closure member is attached at one end to a puller and the puller is attached to the slider. In a preferred embodiment the closure member can pivot about the housing and block withdrawal of the slider from the housing in its closed position.

11 Claims, 5 Drawing Sheets

SECURITY DEVICE

BACKGROUND OF THE INVENTION

1. Field of the Invention

This invention relates to a security device for a slide fastener and relates particularly, though not exclusively, to a security device for re-useable security envelopes.

2. Background Art

Re-useable security envelopes are commonplace for the transportation of documents or articles between various offices of a business or government departments. The envelope is made from a sturdy material, e.g., plastics, canvas, et cetera, which is sealed around the edges. A slide fastener or zipper closes an opening in the envelope to allow entry to the envelope. Articles are placed in the envelope and the zip slider is drawn across the zip chain of teeth fitted to the tapes of the slide fastener to close the envelope. In order to prevent tampering of the contents of the envelope a security device is fitted to both the zip chain and the security envelope to prevent, or make evident, any unauthorized access to the envelope. Typically, the security device is fitted to secure the slider and includes a disposable numbered identification tag which must be broken to release the slider. Any tampering is clearly visible if the tag has been broken. It is not possible to substitute a tag that has been broken to avoid suspicion that the security of the envelope has been compromised as each tag has its own unique number with a no repeat in six million numbered combinations.

Examples of such devices are shown in U.S. Pat. Nos. 4,112,990, 4,008,914, 4,602,405 and 3,955,842. These devices which have proved popular as the disposable tags or plugs that provide visual evidence of tampering, are inexpensive to mass produce and provide a certain degree of security. Unfortunately, these devices can be easily manipulated using dexterity and lock picks to release the disposable tag or plug without damage thereto. The slide fastener can then be released and the contents of the envelope taken or substituted. The tag or plug can then be re-inserted in the usual manner and there will be no evidence of tampering. The applicant has determined that the major problem is the external exposure of both the slider and the security device. This allows a thief ready access using lock picks and similar tools.

SUMMARY OF THE INVENTION

It is an object of the present invention to provide a security device for a slide fastener that provides enhanced security over the prior art.

A further object of the invention is to provide a security device for a slide fastener where the slider of the slide fastener is hidden when in use.

With these objects in view, the present invention in a preferred aspect may provide a security device for a slide fastener, the security device including a housing adapted to be fitted to an object to which the slide fastener is attached, the housing substantially surrounding the slider of the slide fastener in its fully closed position, a closure member adapted to co-operate with the housing which, in use, covers the slider to prevent access thereto and a frangible locking element adapted to link the housing to the closure member, the locking element being resiliently yieldable and slidably insertable into the closure member but not retractable therefrom without fracturing the frangible locking element.

Preferably the closure member is attached at one end to a puller and the puller is attached to the slider. In a preferred embodiment the closure member can pivot about the housing and block withdrawal of the slider from the housing in its closed position.

In a practical embodiment the housing includes a receptacle or guide member which aligns with a slot in the closure member in its closed position and the frangible locking element includes barbs or hooks which lock behind the guide member to prevent extraction of said frangible locking element from the housing and the closure member.

The housing may include a spreader which spreads the barbs apart during insertion of the frangible locking element into the closure member to further assist in preventing extraction of the frangible locking element from the housing and the closure member.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DESCRIPTION OF A PREFERRED EMBODIMENT

Figure 1:
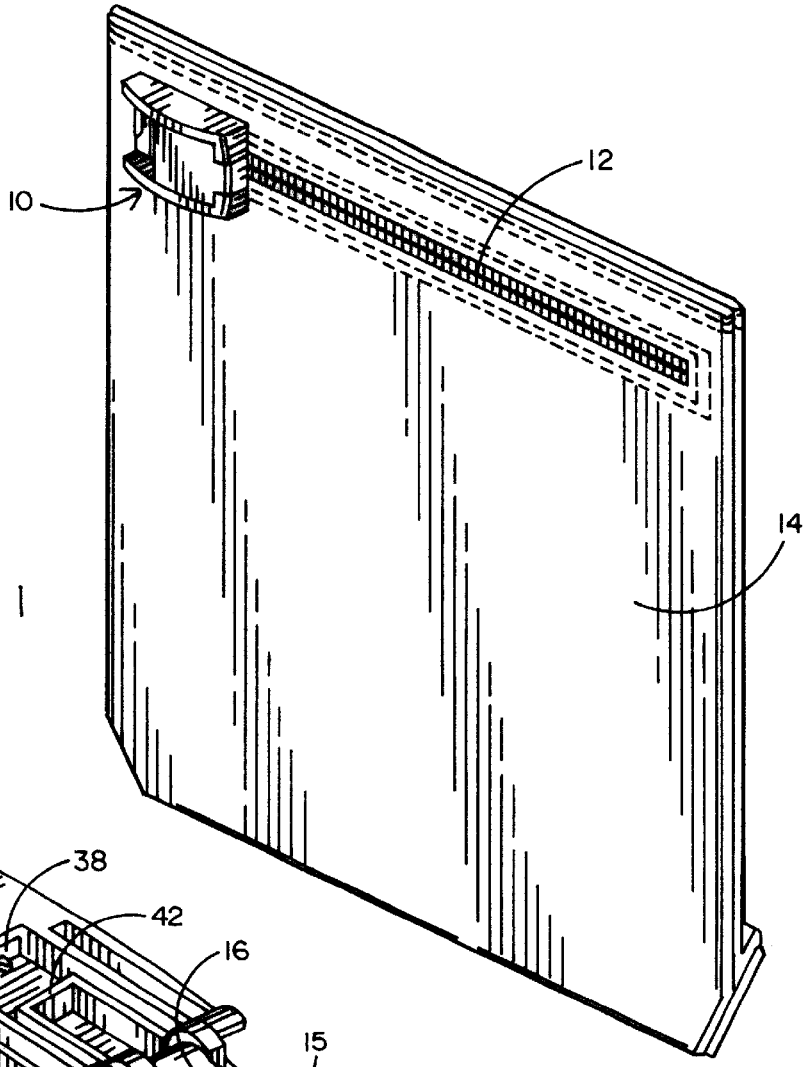
FIG. 1 is a view of a zippered security file which utilizes the security device of the present invention.
Figure 2:
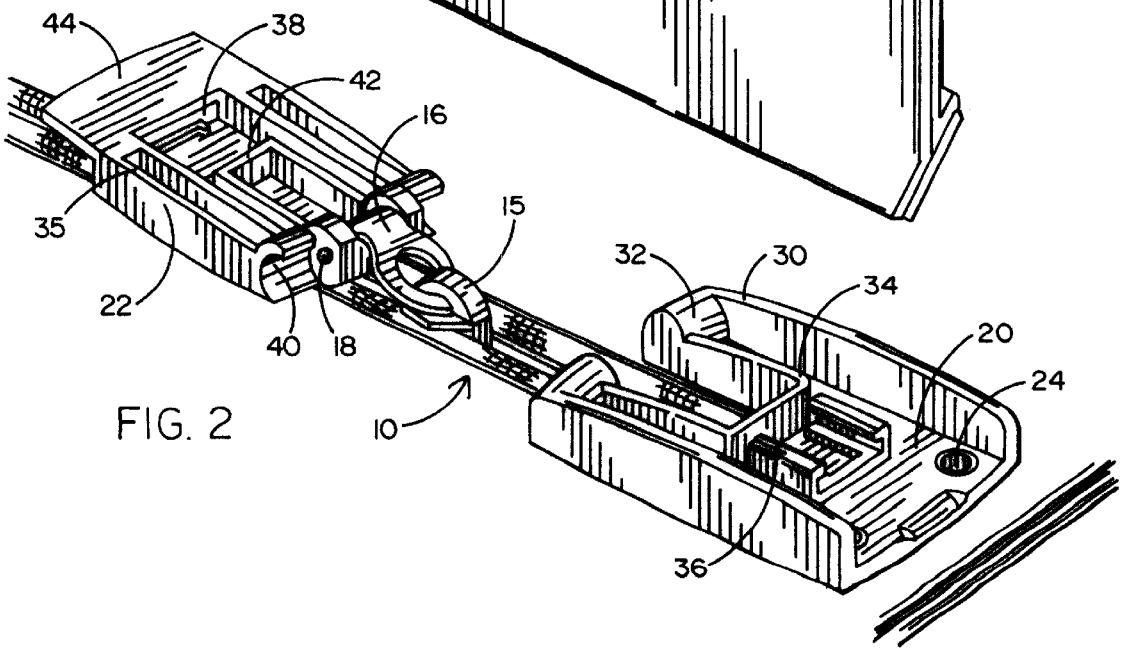
FIG. 2 is a view of a preferred embodiment of the security device of the present invention shown in the fully opened position.

Referring to the accompanying drawings, it will be seen that a preferred embodiment of the security device operates as a seal enclosure 10 connected to a zipper 12 of a security file 14. As seen best in FIG. 2, the zipper slider 15 is connected to a puller 16 which is, in turn, connected to a pin 18 in a closure member 22 which constitutes the moveable part of the seal enclosure 10. The fixed part of the seal enclosure comprises a housing 20 which is permanently affixed to the security file 14 by a plurality of rivets 24 or equivalent fasteners.

It will be seen hereinafter that the closure member 22 is locked to the housing 20 by a frangible seal 25 which comprises a handle portion 26 and a pair of spine-loaded barbed hooks 28. Housing 20 comprises a frame 30 having a pair of spaced apart pivot members 32 and an outer slider barrier 34. Immediately adjacent outer slider barrier 34 is a seal receptacle 36 configured to receive the hooks 28 of seal 25.

Closure member 22 comprises a frame 35 having a closure flange 44 extending therefrom and an aperture 38 at the junction of the frame and the flange. Frame 35 terminates in a pair of arched claws 40 and also comprises an inner slider barrier 42.

Figure 3:
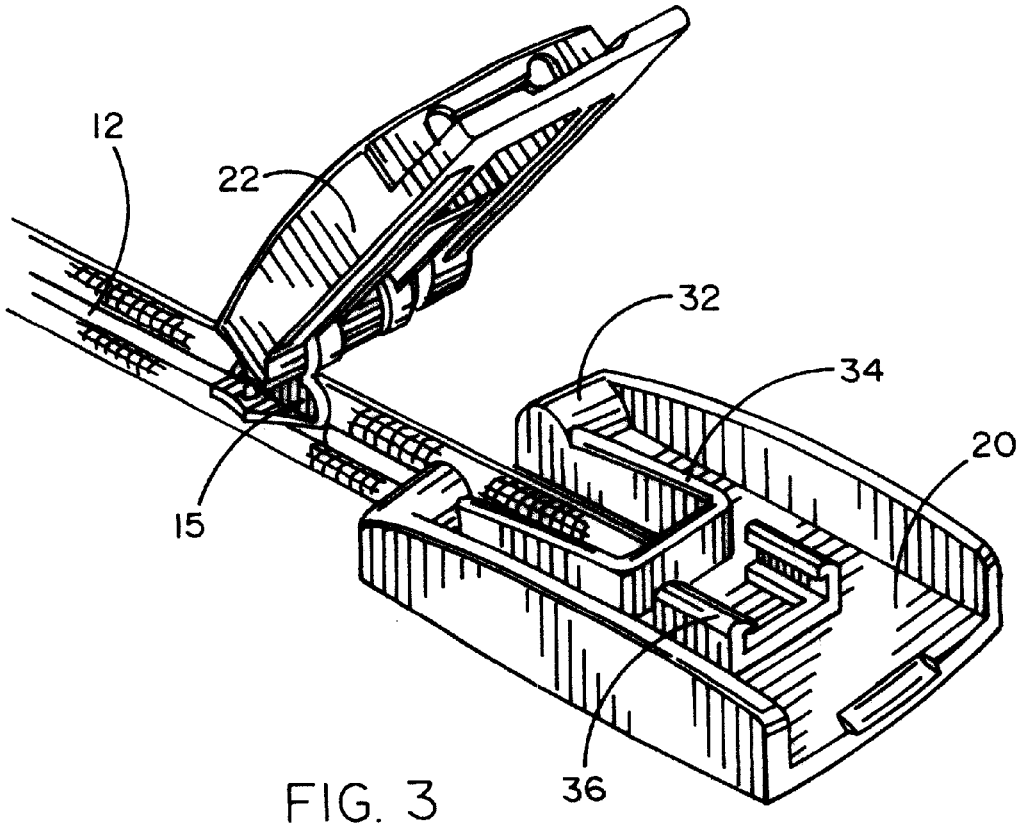
FIGS. 3–6 illustrate in sequence the process in closing and locking the security device.
Figure 4:
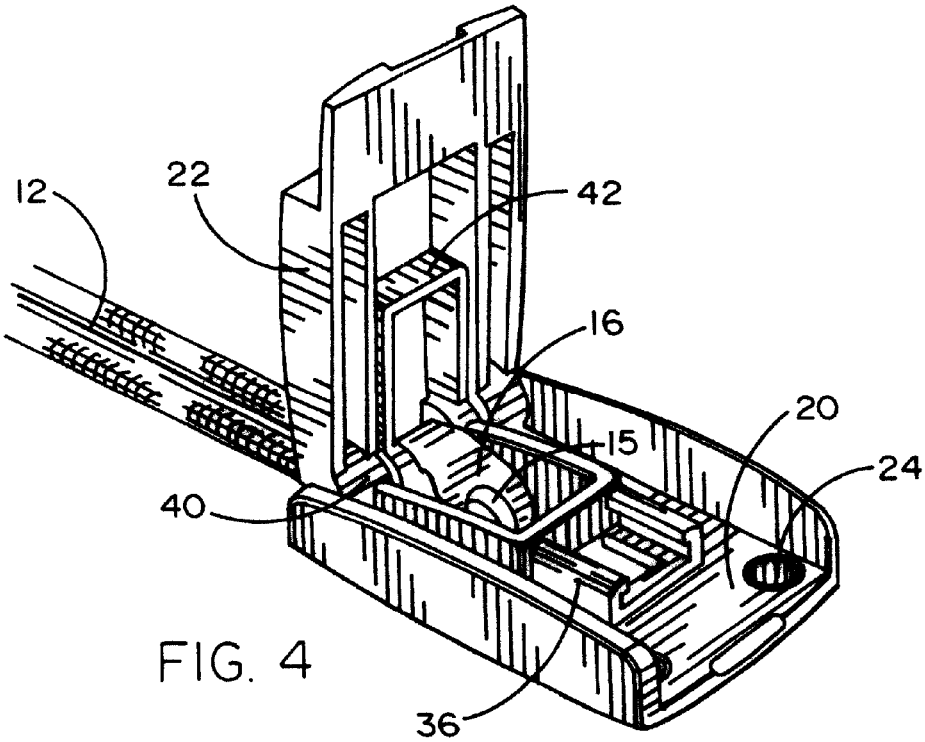
Figure 5:
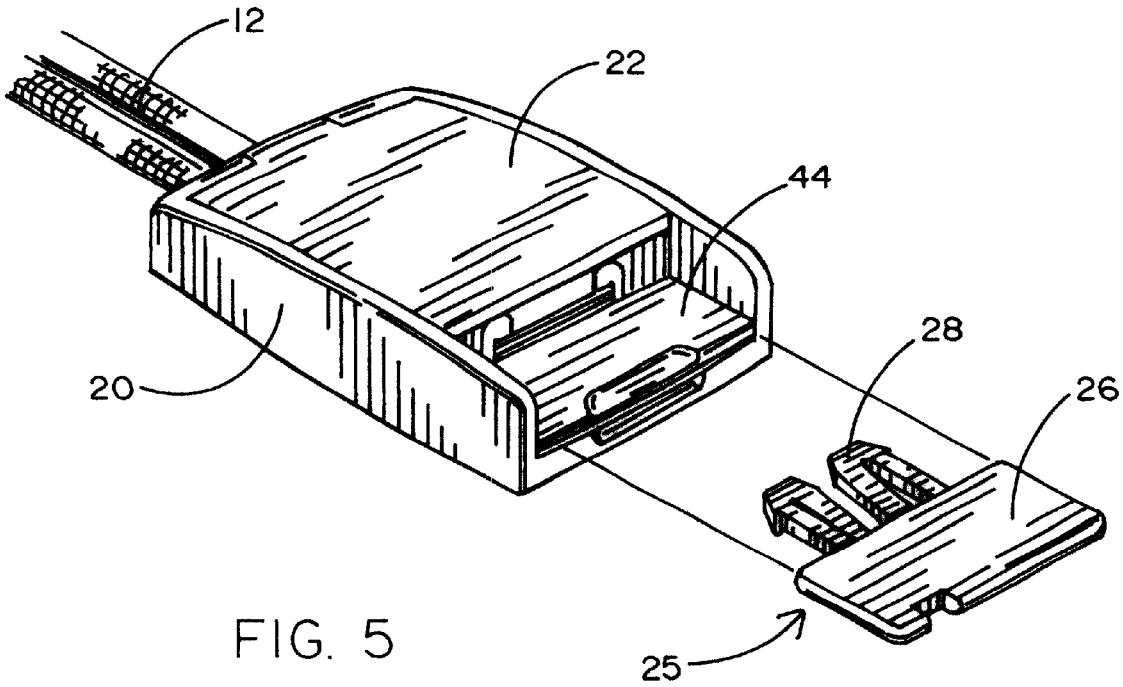

In operation, the seal enclosure 10 may be best understood by referring to FIGS. 3 to 8 in sequence. In FIG. 3 the closure member 22 is separated from housing 20 because zipper slider 15 is spaced from the housing. In FIG. 4 the slider is fully into barrier 34 and claws 40 have engaged pivot members 32 for rotation around the pivot members. In FIG. 5 closure member 22 has been rotated into a fully closed position until flange 44 is in contact with housing 20. Inner barrier 42 nests within outer barrier 34.

Figure 6:
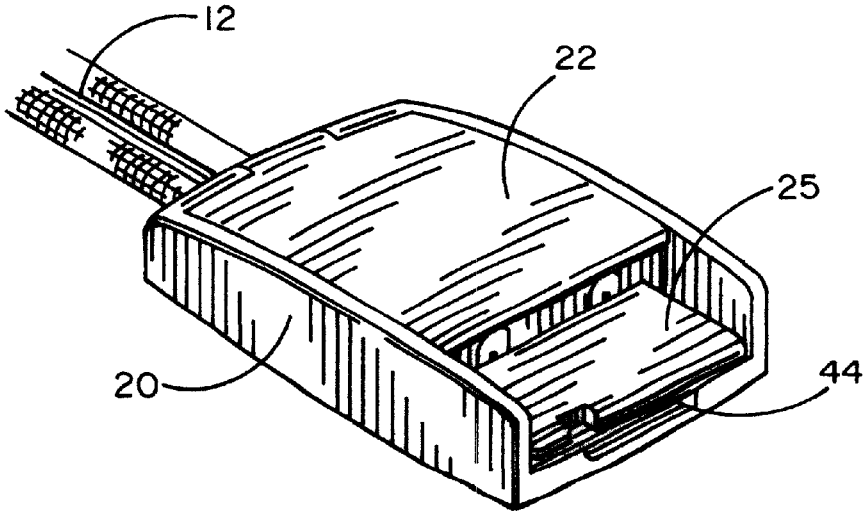
Figure 7:
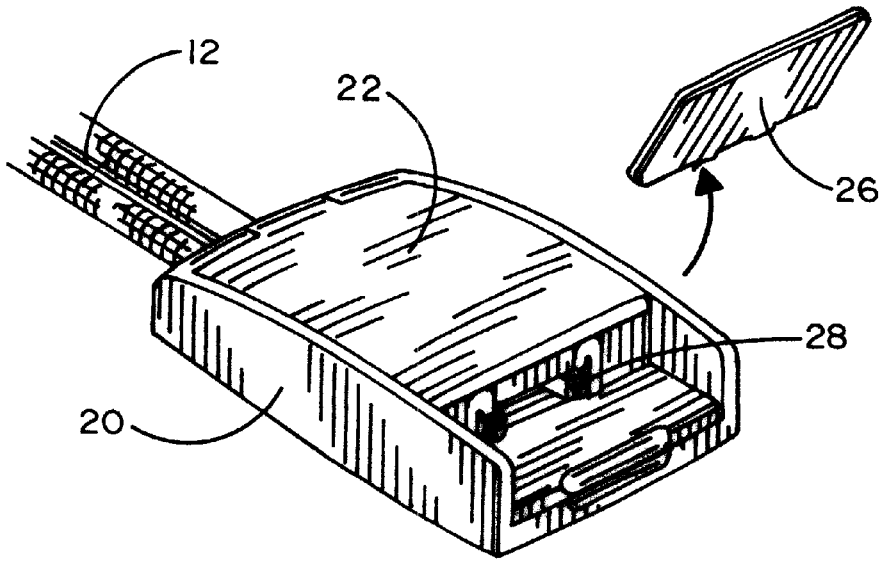
FIGS. 7 and 8 illustrate the required steps to open the security device.
Figure 8:
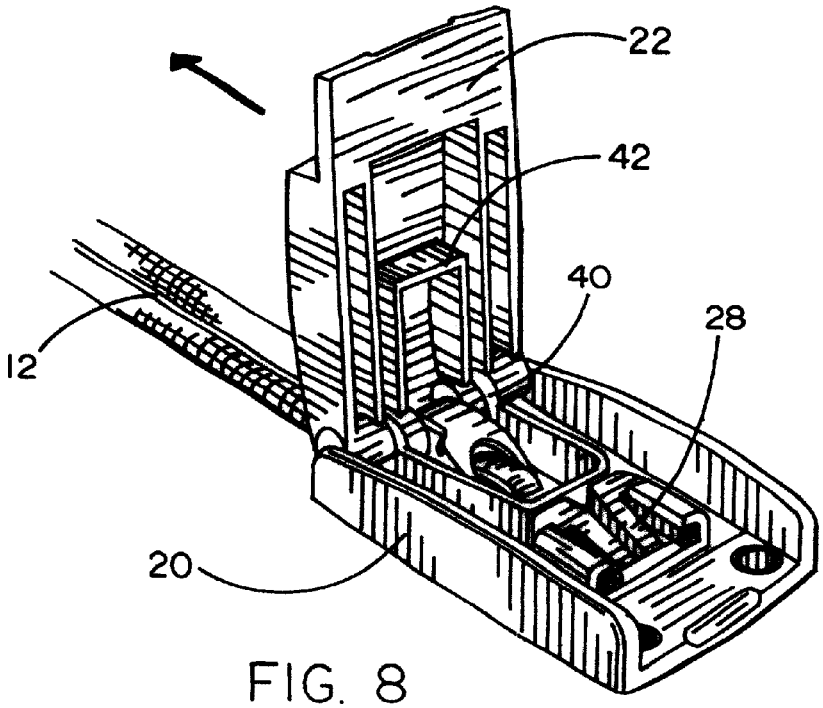
Figure 9:
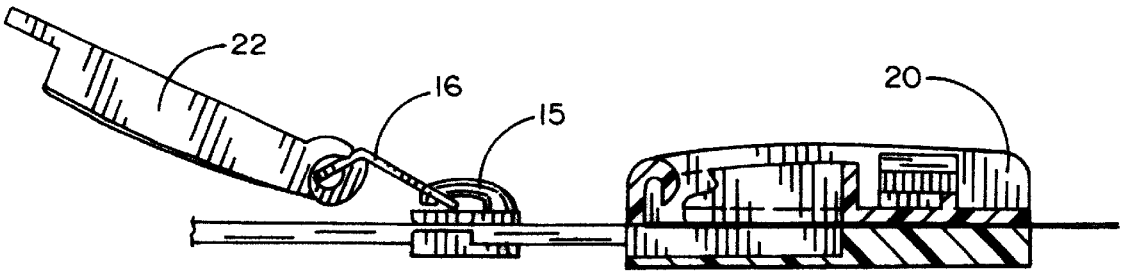
FIGS. 9 and 10 illustrate in side, partially cross-sectioned view, the security device in a fully opened configuration and in a partially open configuration, respectively.
Figure 10:
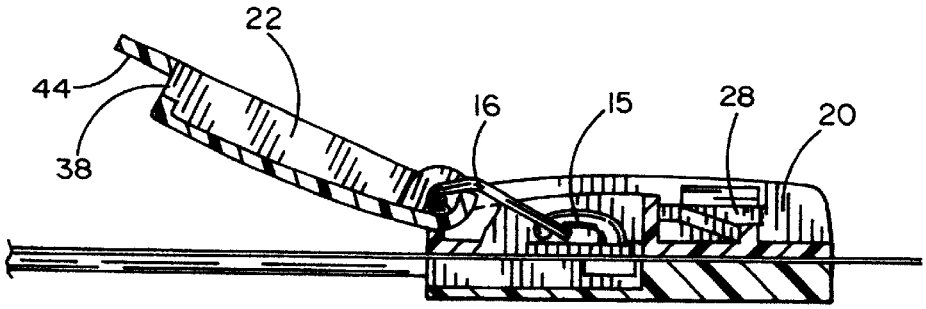

As shown in FIGS. 5 and 6, seal 25 and specifically hooks 28, are then inserted through aperture 38 and through seal receptacle 36 until handle 26 rests on closure flange 44 as shown in FIG. 6. To then open file 14, handle 26 must be broken and separated from hooks 28 as shown in FIG. 7. Closure member 22 can then be rotated to allow claws 40 to be lifted from pivot members 32 and to allow slider 15 to be removed from barrier 34.

A principal feature of the present invention is the degree to which the enclosure renders the seal externally inaccessible in the configuration of FIG. 6. Thus, the present invention overcomes the disadvantages of prior art seals by denying all attempts to open zipper 12 of file 14 without breaking seal 25.

Having thus disclosed a preferred embodiment of the invention, it will be understood that various modifications can be readily made and that numerous alternative enclosure configurations would satisfy the aforementioned objects of the invention. Accordingly, the scope hereof is limited only by the appended claims and their equivalents.

What is claimed is:

1. A seal enclosure for use with a tamper evident frangible seal for securing file having zippered opening; the enclosure comprising:

a housing permanently affixed to said file adjacent said zippered opening;

a closure member pivotally and releasably attached to said housing and forming a selectively closed barrier around said seal to prevent access to said seal without first breaking said seal.

2. The seal enclosure recited in claim 1 wherein said closure member comprises an aperture for receiving said seal.

3. The seal enclosure recited in claim 1 wherein said zippered opening comprises a slider and wherein said closure member is attached to said slider for movement along said zippered opening for opening said file.

4. The seal enclosure recited in claim 1 wherein said closure member and said housing each comprise a frame for entirely surrounding said seal.

5. The seal enclosure recited in claim 3 wherein said closure member and said housing each comprise a barrier for substantially surrounding said slider.

6. An improved tamper evident seal which uses a breakable seal member to provide evidence of opening a file, the seal member having at least one spring-loaded hook, and also having a seal receptacle receiving said hook for preventing hook removal without first breaking the seal member; the improvement comprising:

a multi-piece seal enclosure having a housing permanently affixed to said file and a closure member pivotally secured to said housing by said seal member;

said seal enclosure entirely enclosing said at least one spring-loaded hook for denying external access to said hook without first separating said closure member from said housing.

7. The improvement recited in claim 6 wherein said file comprises a zippered opening and a slider for opening and closing said zippered opening, and wherein said closure member is affixed to said slider.

8. The improvement recited in claim 6 wherein said closure member comprises an aperture for receiving said seal.

9. The improvement recited in claim 6 wherein said closure member and said housing each comprise a frame for entirely surrounding said seal.

10. The improvement recited in claim 7 wherein said closure member and said housing each comprise a barrier for substantially surrounding said slider.

11. A security device for a slide fastener; the security device comprising:

a housing having fasteners to be fitted to an object to which the slide fastener is attached, the housing substantially surrounding a slider of said slide fastener in its fully closed position;

a closure member pivotally cooperating with said housing to selectively prevent access to said slider;

a locking element being resiliently yieldable and slidably insertable into said closure member, but not retractable from said closure member without first fracturing the locking element.

* * * * *